US011225068B2

(12) United States Patent
Anderson et al.

(10) Patent No.: US 11,225,068 B2
(45) Date of Patent: Jan. 18, 2022

(54) FLUIDIC ACTUATOR ACTIVATIONS FOR SENSE MEASUREMENTS

(71) Applicant: Hewlett-Packard Development Company, L.P., Spring, TX (US)

(72) Inventors: Daryl E. Anderson, Corvallis, OR (US); Eric T. Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/970,482

(22) PCT Filed: Apr. 6, 2018

(86) PCT No.: PCT/US2018/026546
§ 371 (c)(1),
(2) Date: Aug. 17, 2020

(87) PCT Pub. No.: WO2019/194831
PCT Pub. Date: Oct. 10, 2019

(65) Prior Publication Data

US 2021/0016566 A1 Jan. 21, 2021

(51) Int. Cl.
*B41J 2/175* (2006.01)
*B41J 2/125* (2006.01)

(52) U.S. Cl.
CPC ..... *B41J 2/125* (2013.01); *B41J 2/175* (2013.01)

(58) Field of Classification Search
CPC ..... B41J 2/175; B41J 2/125; B41J 2/04541; B41J 2/14153; B41J 2/0458; B41J 2/145; B29C 64/209; B29C 64/393; B33Y 30/00; B33Y 50/02
See application file for complete search history.

(56) References Cited

U.S. PATENT DOCUMENTS

| | | | |
|---|---|---|---|
| 6,130,683 | A | 10/2000 | Ju |
| 6,257,694 | B1 | 7/2001 | Tokumaru et al. |
| 6,616,256 | B1 | 9/2003 | Cook et al. |
| 6,698,862 | B1 | 3/2004 | Choi et al. |
| 7,635,174 | B2 | 12/2009 | Bergstedt et al. |

(Continued)

FOREIGN PATENT DOCUMENTS

| | | |
|---|---|---|
| EP | 1413435 | 4/2004 |
| WO | WO-2013158105 | 10/2013 |

(Continued)

*Primary Examiner* — Anh T Vo
(74) *Attorney, Agent, or Firm* — Trop Pruner & Hu PC

(57) ABSTRACT

In some examples, a fluid dispensing device includes a plurality of fluidic actuators, activate data storage elements, and sense measurement storage elements. The fluid dispensing device includes a decoder to detect, based on a first activate indicator of the activate indicators, that a first fluidic actuator is to be activated, detect, based on a first sense measurement indicator of the sense measurement indicators that a sense measurement is to be performed on the first fluidic actuator, and in response to detecting that the first fluidic actuator is to be activated and the sense measurement is to be performed on the first fluidic actuator, suppress activation of the first fluidic actuator at a first time, and activate the first fluidic actuator at a second time corresponding to a sense measurement interval to perform the sense measurement of the first fluidic actuator.

15 Claims, 7 Drawing Sheets

(56) References Cited

U.S. PATENT DOCUMENTS

| | | | |
|---|---|---|---|
| 8,708,449 | B2 | 4/2014 | Shinkawa |
| 8,899,711 | B2 | 12/2014 | Masuda et al. |
| 9,493,002 | B2 | 11/2016 | Edelen et al. |
| 9,776,395 | B2 | 10/2017 | Anderson et al. |
| 2006/0125858 | A1 | 6/2006 | Silverbrook et al. |
| 2008/0084444 | A1 | 4/2008 | Sheahan et al. |
| 2010/0231625 | A1 | 9/2010 | Walmsley et al. |
| 2011/0084997 | A1 | 4/2011 | Chen et al. |
| 2013/0278656 | A1 | 10/2013 | Govyadinov et al. |
| 2013/0278657 | A1 | 10/2013 | Martin et al. |
| 2014/0210881 | A1 | 7/2014 | Van Brocklin et al. |
| 2016/0271940 | A1 | 9/2016 | Martin et al. |
| 2017/0225455 | A1 | 8/2017 | Veenstra et al. |

FOREIGN PATENT DOCUMENTS

| | | |
|---|---|---|
| WO | WO-2017131761 | 8/2017 |
| WO | WO-2019-194831 | 10/2019 |
| WO | WO-2019194828 | 10/2019 |
| WO | WO-2019194829 | 10/2019 |
| WO | WO-2019194832 | 10/2019 |
| WO | WO-2019194834 | 10/2019 |

FLUIDIC ACTUATOR ACTIVATIONS FOR SENSE MEASUREMENTS

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead devices that include fluidic actuators to cause dispensing of printing fluids.

BRIEF DESCRIPTION OF THE DRAWINGS

Some implementations of the present disclosure are described with respect to the following figures.

Figure 1:
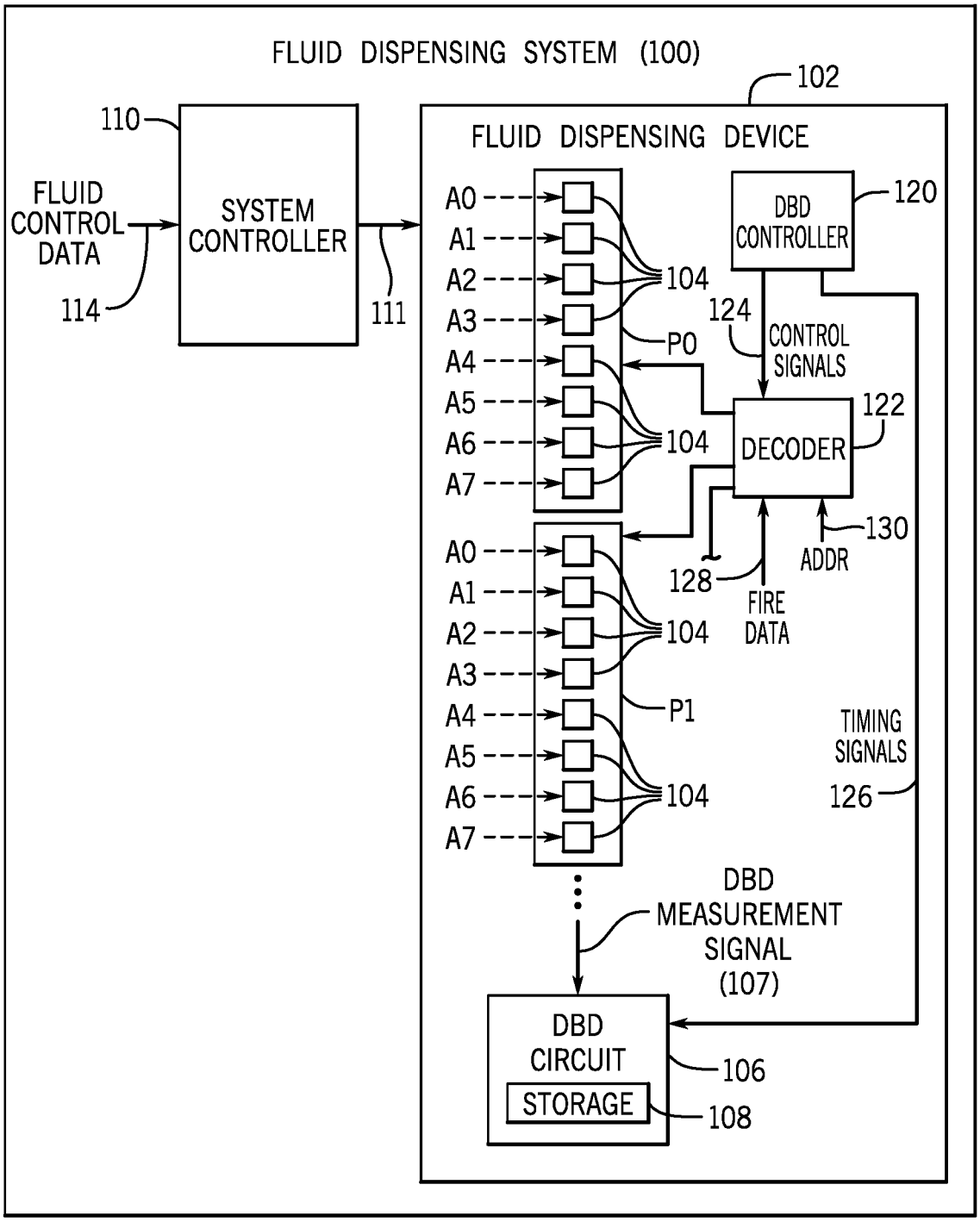
FIG. 1 is a block diagram of a fluid dispensing system including a system controller and a fluid dispensing device according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing device can include fluidic actuators that when activated cause dispensing (e.g., ejection or other flow) of a fluid. For example, the dispensing of the fluid can include ejection of fluid droplets by activated fluidic actuators from respective nozzles of the fluid dispensing device. In other examples, an activated fluidic actuator (such as a pump) can cause fluid to flow through a fluid conduit or fluid chamber. Activating a fluidic actuator to dispense fluid can thus refer to activating the fluidic actuator to eject fluid from a nozzle or activating the fluidic actuator to cause a flow of fluid through a flow structure, such as a flow conduit, a fluid chamber, and so forth.

Generally, a fluidic actuator can be an ejecting-type fluidic actuator to cause ejection of a fluid, such as through an orifice of a nozzle, or a non-ejecting-type fluidic actuator to cause flow of a fluid.

Activating a fluidic actuator can also be referred to as firing the fluidic actuator. In some examples, the fluidic actuators include thermal-based fluidic actuators including heating elements, such as resistive heaters. When a heating element is activated, the heating element produces heat that can cause vaporization of a fluid to cause nucleation of a vapor bubble (e.g., a steam bubble) proximate the thermal-based fluidic actuator that in turn causes dispensing of a quantity of fluid, such as ejection from an orifice of a nozzle or flow through a fluid conduit or fluid chamber. In other examples, a fluidic actuator may be a piezoelectric membrane based fluidic actuator that when activated applies a mechanical force to dispense a quantity of fluid.

In examples where a fluid dispensing device includes nozzles, each nozzle includes a fluid chamber, also referred to as a firing chamber. In addition, a nozzle can include an orifice through which fluid is dispensed, a fluidic actuator, and a sensor. Each fluid chamber provides the fluid to be dispensed by the respective nozzle. Prior to a droplet release, the fluid in the fluid chamber is restrained from exiting the nozzle due to capillary forces and/or back-pressure acting on the fluid within the nozzle passage.

During a droplet release from a nozzle, the fluid within the fluid chamber is forced out of the nozzle by actively increasing the pressure within the fluid chamber. In some example fluid dispensing devices, a resistive heater positioned within the fluid chamber when activated vaporizes a small amount of at least one component of the fluid. In some cases, a major component of the fluid (such as liquid ink for printing systems or other types of fluids) is water, and the resistive heater vaporizes the water. The vaporized fluid component expands to form a gaseous drive bubble within the fluid chamber. This expansion exceeds a restraining force on the fluid within the fluid chamber enough to expel a quantity of fluid (a single fluid droplet or multiple fluid droplets) out of the nozzle. Generally, after the release of fluid droplet, the pressure in the fluid chamber drops below the strength of the restraining force and the remainder of the fluid is retained within the fluid chamber. Meanwhile, the drive bubble collapses and fluid from a reservoir for the fluid dispensing device flows into the fluid chamber to replenish the lost fluid volume resulting from the fluid droplet release. The foregoing process is repeated each time the nozzle of the fluid dispensing device is instructed to fire.

In other examples with non-ejecting fluidic actuators, the drive bubble formed by activation of a non-ejecting fluidic actuator causes movement of fluid through a fluid conduit or fluid chamber.

After repeated use of the fluidic actuators of a fluid dispensing device, the fluidic actuators or flow structures associated with the fluidic actuators may develop defects (e.g., a nozzle, fluid conduit, or fluid chamber may become clogged, a fluidic actuator may malfunction, etc.) and hence may not operate in a target manner. As a result, fluid dispensing performance of the fluidic actuators may degrade over time and use.

In some examples, fluidic actuator health can be determined by performing drive bubble detection (DBD) measurements for each fluidic actuator. DBD measurements can allow for detection of characteristics of a drive bubble and a fluid in a fluid chamber or fluid channel. From these characteristics, qualities of the drop ejected or fluid moved can be inferred, so that servicing or replacement of a degraded fluid dispensing device can be performed.

Although reference is made to DBD measurements in some examples, it is noted that techniques or mechanisms according to some implementations of the present disclosure can also be applied to other types of sense measurements of fluidic actuators. A sense measurement of a fluidic actuator refers to measuring a characteristic of the fluidic actuator and/or flow structure associated with the fluidic actuator for determining a condition of the fluidic actuator and/or flow structure.

A fire event can refer to a signal or other indication that is provided to activate a fluidic actuator. A fire event to activate a fluidic actuator can refer to a fire event to activate a single fluidic actuator or a group of fluidic actuators. In some examples, a DBD measurement for a fluidic actuator is performed in response to a fire event. In some cases, to obtain multiple DBD measurements for a fluidic actuator, the fluidic actuator can be fired multiple times in response to respective multiple fire events.

In some examples, activating a fluidic actuator to perform a DBD measurement can cause ejection of a fluid droplet from a corresponding nozzle or cause other dispensing of an amount of fluid, which can lead to increased fluid usage. Also, in printing applications, ejection of a fluid droplet during a sense measurement can lead to the fluid droplet being deposited onto a print medium or other print target, which may be undesirable since the fluid droplet can cause a noticeable artifact on the print medium or other print target.

In accordance with some implementations of the present disclosure, extra ejection or flow of fluid from nozzles or other flow structures subject to sense measurements (e.g., DBD measurements) can be suppressed by providing circuitry as part of a fluid dispensing device to detect, based on a given activate indicator of plural activate indicators associated with respective fluidic actuators, that a given fluidic actuator is to be activated, and detect, based on a given sense measurement indicator of plural sense measurement indicators associated with the respective fluidic actuators, that a sense measurement is to be performed on the given fluidic actuator. In response to detecting that the given fluidic actuator is to be activated and the sense measurement is to be performed on the given fluidic actuator, the circuit suppresses activation of the given fluidic actuator at a first time, and activates the given fluidic actuator at a second time corresponding to a sense measurement interval to perform the sense measurement of the given fluidic actuator.

FIG. 1 is a block diagram of a fluid dispensing system 100, according to some examples. The fluid dispending system 100 can be a printing system, such as a 2D printing system or a 3D printing system. In other examples, the fluid dispending system 100 can be a different type of fluid dispensing system. Examples of other types of fluid dispensing systems include those used in fluid sensing systems, medical systems, vehicles, fluid flow control systems, and so forth.

The fluid dispensing system 100 includes a fluid dispensing device 102 for dispensing fluid. In a 2D printing system, the fluid dispensing device 102 includes a printhead that ejects printing fluid (e.g., ink) onto a print medium, such as a paper medium, a plastic medium, and so forth.

In a 3D printing system, the fluid dispensing device 102 includes a printhead that can eject any of various different printing fluids onto a print target, where the printing fluids can include any or some combination of the following: ink, an agent used to fuse powders of a layer of build material, an agent to detail a layer of build material (such as by defining edges or shapes of the layer of build material), and so forth. In a 3D printing system, a 3D target is built by depositing successive layers of build material onto a build platform of the 3D printing system. Each layer of build material can be processed using the printing fluid from a printhead to form the desired shape, texture, and/or other characteristic of the layer of build material.

In some examples, the fluid dispensing device 102 can be a fluid dispensing die. A "die" refers to an assembly where various layers are formed onto a substrate to fabricate circuitry, fluid chambers, and fluid conduits.

The fluid dispensing device 102 includes an array of fluidic actuators 104. The array of fluidic actuators 104 can include a column of fluidic actuators, or multiple columns of fluidic actuators. The fluidic actuators 104 can be organized into multiple primitives, where each primitive includes a specified number of fluidic actuators. FIG. 1 shows primitives P0 and P1. Each primitive P0 or P1 includes 8 fluidic actuators. In other examples, a primitive can include a different number of fluidic actuators. Also, the array of fluidic actuators 104 can include more than two primitives.

The fluidic actuators 104 can be part of nozzles or can be associated with other types of flow structures, such as fluid conduits, fluid chambers, and so forth. Each fluidic actuator is selected by a respective different address. Thus, in the example of FIG. 1, the fluidic actuators in the nozzles of the primitive P0 are selected by respective addresses A0-A7, and similarly, the fluidic actuators in the nozzles of the primitive P1 are selected by respective addresses A0-A7.

In some examples, fluidic and electrical constraints can prevent firing of all of the fluidic actuators 104 simultaneously. To fire all the fluidic actuators, data (e.g., in the form of a first data packet) is loaded to activate all fluidic actuators in the primitives for a first address (e.g., A0), then data (e.g., in the form of a second data packet) is loaded to activate all fluidic actuators selected by a second address (e.g., A1), and so forth.

In some examples, fire data (also referred to as "activate data") to control activation or non-activation of a fluidic actuator in each primitive can be loaded on a per-fluidic actuator basis. In some examples, loading fire data on a per-fluidic actuator basis is performed for a fluid dispensing device that has a full column buffer (FCB) arrangement. In the FCB arrangement, fire data is loaded for all fluidic actuators in an array of fluidic actuators (e.g., column of fluidic actuators). As a result, fire data does not have to be loaded on each successive activation interval of multiple activation intervals for activating fluidic actuators of a primitive. Rather, since the fire data has been loaded for all fluidic actuators of the array of fluidic actuators, such loaded fire data for the individual fluidic actuators can be used to control activation of respective fluidic actuators. Once fire data has been loaded for all fluidic actuators, fire pulses and address data are provided to all primitives (i.e., for an 8-address primitive, 8 fire pulses, each with a unique address, are sent before the next FCB data packet is loaded).

A sequence of multiple time intervals to activate respective fluidic actuators of a primitive can be referred to as a time group of activation intervals (also referred to as a "column group" of activation intervals). The activation intervals of a column group correspond to different addresses (e.g., A0-A7) that select respective different fluidic actuators of a primitive. In the example of FIG. 1, the 8 fluidic actuators of each primitive can be activated in the respective 8 activation intervals of a column group.

In accordance with some implementations of the present disclosure, as shown in FIG. 1, the fluid dispensing device 102 further includes a DBD controller 120 and a decoder 122 that is used to control activation of fluidic actuators 104, where the activation of a fluid actuator can be a normal activation of the fluid actuator or a sense measurement activation of the fluid actuator to perform a sense measurement.

As used here, a "controller" can refer to a hardware processing circuit or a combination of a hardware processing circuit and machine-readable instructions executable on the hardware processing circuit. A hardware processing circuit can include any or some combination of the following: a microprocessor, a core of a multi-core microprocessor, a microcontroller, a programmable integrated circuit, a programmable gate array, or another hardware processing circuit.

The decoder 122 can also refer to a hardware processing circuit or a combination of a hardware processing circuit and machine-readable instructions executable on the hardware processing circuit.

A "normal activation" of a fluidic actuator refers to activating the fluidic actuator in a scheduled activation interval, as scheduled by a system controller 110 of the fluid dispensing system 100. A "sense measurement" activation of a fluidic actuator refers to activating the fluidic actuator in a sense measurement interval that is shifted in time from a scheduled activation interval (also referred to as a "normal activation interval").

The DBD controller 120 provides control signals 124 to control the operation of the decoder 122. Further details regarding the control signals 124 are provided below. The DBD controller 120 also provides timing signals 126 to a DBD circuit 106.

The DBD circuit 106 can receive a DBD measurement signal 107 output by a sensor (that is associated with an activated fluidic actuator) of a nozzle (or other flow structure) that is subjected to a DBD measurement. In examples where the fluid dispensing device 102 includes nozzles, the nozzles can include respective sensors. In other examples, the sensors can be included in other flow structures through which fluid can be dispensed by activations of respective fluidic actuators.

A sensor includes a fluid property sensor to measure a fluid property of the nozzle or other flow structure. The sensor can measure a fluid property concurrent with activation of an associated fluidic actuator. In examples where a fluidic actuator is a thermal based fluidic actuator, the sensor can be used (via sense circuits) to sense a fluid property during formation and collapse of a vapor bubble.

In other examples where the fluidic actuator is a piezoelectric membrane based fluidic actuator, the sensor may be used (via sense circuits) to sense a fluid property during actuation of the piezoelectric membrane that causes ejection or other movement of a quantity of fluid.

In some examples, a sensor can include an impedance sensor to measure variations in the impedance associated with a nozzle or other flow structure due to formation of a drive bubble. In other examples, other types of sensors can be used to measure characteristics of the nozzle or other flow structure due to formation of a drive bubble.

In an example, if a first fluidic actuator of the primitive P0 (which can be any of the fluidic actuators selected by addresses A0-A7) is the subject of a DBD measurement, then the DBD circuit 106 receives the DBD measurement signal 107 from the sensor associated with the first fluidic actuator of the primitive P0. Similarly, if a second fluidic actuator of the primitive P1 (which can be any of the fluidic actuators selected by addresses A0-A7) is the subject of a DBD measurement, then the DBD circuit 106 receives the DBD measurement signal 107 from the sensor associated with the second fluidic actuator in the primitive P1.

In some examples, just one fluidic actuator is selected per array of fluidic actuators 104 for performing a DBD measurement. In other examples, more than one fluidic actuator can be selected for DBD measurement in an array of fluidic actuators 104.

The DBD circuit 106 includes a storage 108 to store a value corresponding to the DBD measurement signal 107 received from the sensor associated with the fluidic actuator that is subject to the DBD measurement. The storage 108 can be a memory, a storage capacitor, a latch, a register, or any other type of storage element.

The storage 108 can store an analog signal corresponding to the DBD measurement signal 107, or a digital value based on the DBD measurement signal 107. To produce a digital value, for example, the DBD circuit 106 can include a comparator (not shown) to compare the DBD measurement signal 107 from a sensor of a nozzle that is the subject of a DBD measurement, to a specified threshold. The output of the comparator can then be provided to an analog-to-digital (ADC) converter to convert into a digital value that can be stored in the storage 108. In other examples, other ways of producing a digital value based on the DBD measurement signal 107 can be performed.

The timing at which the DBD measurement signal 106 is processed and stored by the DBD circuit 106 is controlled by the timing signals 126 from the DBD controller 120.

The fluid dispensing system 100 also includes the system controller 110 (which is separate from the fluid dispensing device 102) that can control the operation of the fluidic actuators 104 of the fluid dispensing device 102.

The system controller 110 receives fluid control data 114, which controls (schedules) which of the fluidic actuators of the array of fluidic actuators 104 of the fluid dispensing device 102 are to be activated (and which other fluidic actuators are to remain inactive). In a printing system, the fluid control data 114 includes image data that schedules the dispensing of fluid from nozzles in forming an image on a print medium (for 2D printing) or in forming a 3D object (for 3D printing) during a print operation. Alternatively, the fluid control data 114 can schedule the activation of pumps or other fluidic actuators to cause flow of a fluid, such as to distribute pigment particles and so forth.

The system controller 110 provides controller activation data 111 (which may include fire data and address data, among other things like DBD control data) to the fluid dispensing device 102. A data controller (not shown) on the fluid dispensing device 102 processes the received controller activation data 111 and extracts fire data 128 and address signals 130 that are provided to various groups of primitives, to select and control activation of the fluidic actuators 104 in respective activation intervals. In addition, the DBD controller 120 can extract sense measurement select data (e.g., DBD select data) from the DBD control data in the controller activation data 111.

Figure 2:
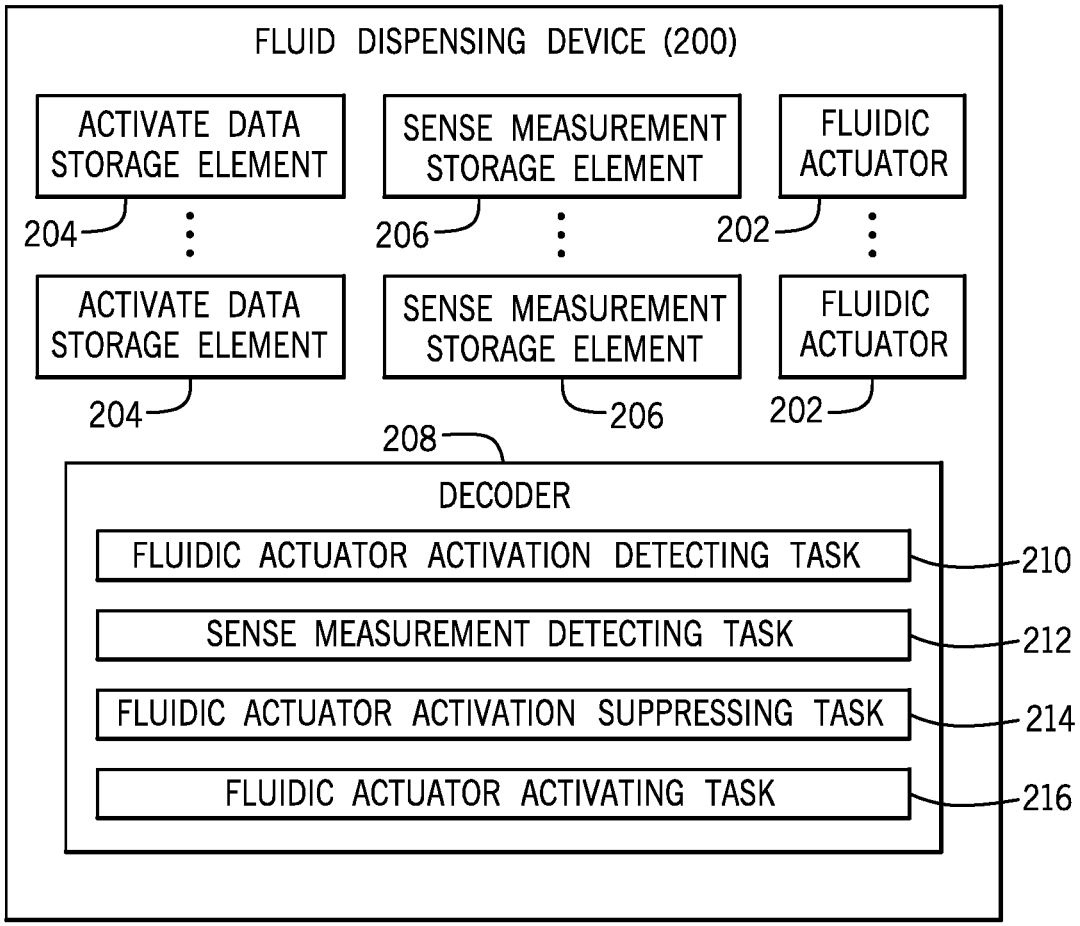
FIG. 2 is a block diagram of a fluid dispensing device according to some examples.

FIG. 2 is a block diagram of a fluid dispensing device 200 according to the FCB arrangement that includes a plurality of fluidic actuators 202, activate data storage elements 204 to store respective activate indicators for controlling activation of respective fluidic actuators of the plurality of fluidic actuators, and sense measurement storage elements 206 to store respective sense measurement indicators for indicating whether the respective fluidic actuators are to be subject to a sense measurement.

The activate data storage elements 204 are individually associated with respective fluidic actuators 202 (i.e., a first activate data storage element 204 stores an activate indicator to control activation of a first fluidic actuator, a second activate data storage element 204 stores an activate indicator to control activation of a second fluidic actuator, and so forth). Since the activate data storage elements 204 are individually associated with respective fluidic actuators 202, the activate indicators for all fluidic actuators of an array (e.g., column) of fluidic actuators can be loaded at once.

Similarly, the sense measurement storage elements 206 are individually associated with respective fluidic actuators 202 (i.e., a first sense measurement storage element 206 stores a sense measurement indicator to indicate whether a first fluidic actuator is to be subject to a sense measurement, a second sense measurement storage element 206 stores a sense measurement indicator to indicate whether a second fluidic actuator is to be subject to a sense measurement, and so forth).

The fluid dispensing device 200 further includes a decoder 208 to perform various tasks. The tasks of the decoder 208 include a fluidic actuator activation detecting task 210 to detect, based on a first activate indicator of the activate indicators, that a first fluidic actuator is to be activated. The tasks further include a sense measurement detecting task 212 to detect, based on a first sense measurement indicator of the sense measurement indicators, that a sense measurement is to be performed on the first fluidic actuator.

The decoder 208 performs a fluidic actuator activation suppressing task 214, and a fluidic actuator activating task 216 in response to detecting that the first fluidic actuator is to be activated and the sense measurement is to be performed on the first fluidic actuator. The fluidic actuator activation suppressing task 214 suppresses activation of the first fluidic actuator at a first time. The fluidic actuator activating task 216 activates the first fluidic actuator at a second time corresponding to a sense measurement interval to perform the sense measurement of the first fluidic actuator.

Figure 3:
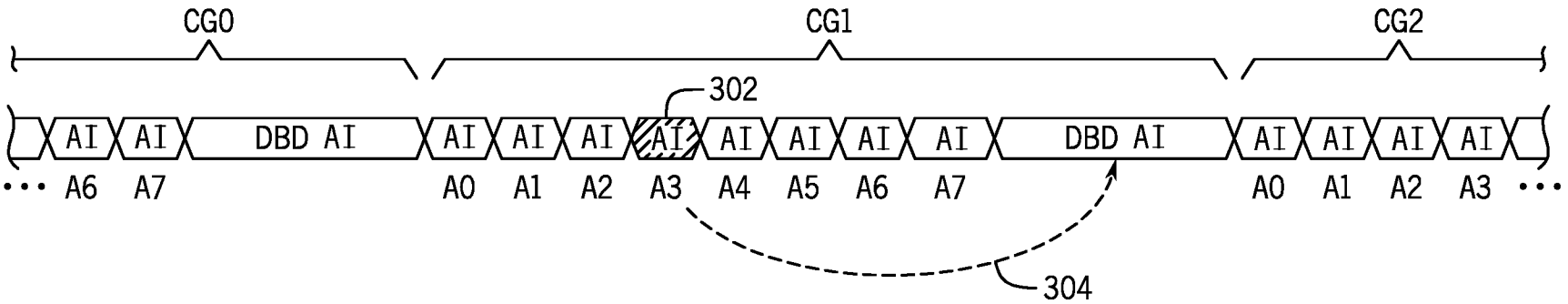
FIG. 3 is a timing diagram illustrating groups of activation intervals, with each group of activation intervals including a sense measurement interval according some examples.

FIG. 3 is a timing diagram that shows multiple column groups CG0, CG1, and CG2. As noted above, each column group includes a sequence of activation intervals (each activation interval designated as "AI" in FIG. 3). The sequence of activation intervals in a column group includes multiple activation intervals that corresponding to respective addresses A0-A7. Such activation intervals can be referred to as "normal activation intervals" since respective fluidic actuators are selected for activation based on the fluid control data 114 in these activation intervals. The series of activation intervals in each column group further includes a DBD activation interval, which is used to activate a fluidic actuator that is the subject of a DBD measurement. The DBD activation interval is an extra activation interval added to a column group in addition to the normal activation intervals that correspond to addresses A0-A7.

For the column group CG1, 8 normal activation intervals are used to activate 8 respective fluidic actuators of a respective primitive (e.g., primitive P1 in FIG. 1) using respective different addresses A0-A7 (assuming the fluid control data 114 specifies that the fluidic actuators of CG1 are to be activated). The column group CG1 further includes a DBD activation interval at the end of the 8 normal activation intervals.

Fire data to control activation or non-activation of fluidic actuators is loaded for the fluidic actuators of an array (e.g., column) of fluidic actuators, such as into the activate data storage elements 204 of FIG. 2. The address sent in an activation interval determines which fluidic actuator in each primitive is conditionally fired depending on the state of that fluidic actuator's fire data. So if, for example, the fluid control data 114 specifies that a given fluidic actuator corresponding to address A3 in primitive P2 is to be fired, then during activation interval 302 (corresponding to address A3), if the fire data for the given fluidic actuator is set active, then activation of the given fluidic actuator corresponding to address A3 in primitive P2 is enabled.

Generally, a fluidic actuator activates if a) the fluidic actuator's fire data is set active, and b) if the current address matches that of the fluidic actuator's assigned address. A given fluidic actuator in a particular primitive is not activated, if in a current activation interval of a column group, either the fire data for the given fluidic actuator is set inactive or a current address for the current activation interval does not match the address of the given fluidic actuator.

Although FIG. 3 shows a DBD activation interval as having a length larger than that of a normal activation interval, it is noted that the longer depicted length of the DBD activation interval is used to represent the fact that a DBD measurement process activates a fluidic actuator, waits a specified amount of time, and samples a measurement signal from the sensor associated with the fluidic actuator. In actuality, the DBD activation interval may have a time length that is the same as or similar to the time length of a normal activation interval.

Also, although FIG. 3 shows the DBD activation interval as being at the end of the group of activation intervals of each column group, it is noted that the DBD activation interval can be provided at a different point relative to the normal activation intervals of the column group. For example, the DBD activation interval can be provided before the normal activation intervals in each column group, or can be provided at any point between the normal activation intervals.

In the example of FIG. 3, it is assumed that the fluid control data 114 has selected a fluidic actuator in a particular primitive (hereinafter referred to as the "selected fluidic actuator") corresponding to normal activation interval 302 (address A3) in the column group CG1 for activation, and further, that the DBD controller 120 has decided (such as in response to a command from the system controller 110) to perform a DBD measurement of the selected fluidic actuator in the column group CG1. This selected fluidic actuator is also referred to as the A3 selected fluidic actuator, since the fluidic actuator is in the particular primitive (fire data for the particular primitive is set active) and is to be activated by address A3 in the corresponding normal activation interval 302.

In a normal operation (i.e., an operation where DBD measurement is not being performed for the column group CG1), the A3 selected fluidic actuator in the column group CG1 would be actuated in the normal activation interval 302. However, in accordance with some implementations of the present disclosure, instead of activating the A3 selected fluidic actuator in the normal activation interval 302, the selected fluidic actuator is instead activated in the DBD activation interval of the column group CG1 to perform a DBD measurement. Effectively, the activation of the selected fluidic actuator has been time shifted (as indicated by 304) from the normal activation interval 302 (which is the activation interval when the selected fluidic actuator would normally be activated) to the DBD activation interval of the column group CG1.

The shifting (304) of the activation of the selected fluidic actuator is performed by a) suppressing activation of the selected fluidic actuator in the normal activation interval 302, which is accomplished by the decoder 122 disabling fluidic actuator in the normal activation interval 302 (described in further detail in connection with FIG. 4 below), and b) the decoder 122 enabling activation of the selected fluidic actuator in the DBD activation interval of the column group CG1 (described in further detail in connection with FIG. 4 below).

In FIG. 3, the shifting (304) of the activation of the selected fluidic actuator for the DBD measurement delays the activation of the selected fluidic actuator. In other examples, if the DBD activation interval is placed earlier in the series of activation intervals of the column group CG1 than the normal activation interval 302, then the shifting (304) causes an earlier activation of the selected fluidic actuator to perform the DBD measurement.

In accordance with some implementations of the present disclosure, a selected fluidic actuator that is to be subject to a DBD measurement is chosen to be one that is already scheduled to fire in one of the normal activation intervals corresponding to addresses A0-A7. However, by shifting the activation of the selected fluidic actuator, the selected fluidic actuator is not activated in the corresponding normal activation interval, but instead is re-scheduled to be activated in the DBD activation interval. Note that the selected fluidic actuator is still activated in the same column group that the selected fluidic actuator is set to be fired based on the fluid control data 114. The activation of the selected fluidic actuator is merely shifted by some amount of time relative to when the selected fluidic actuator was originally scheduled to be activated.

Figure 4:
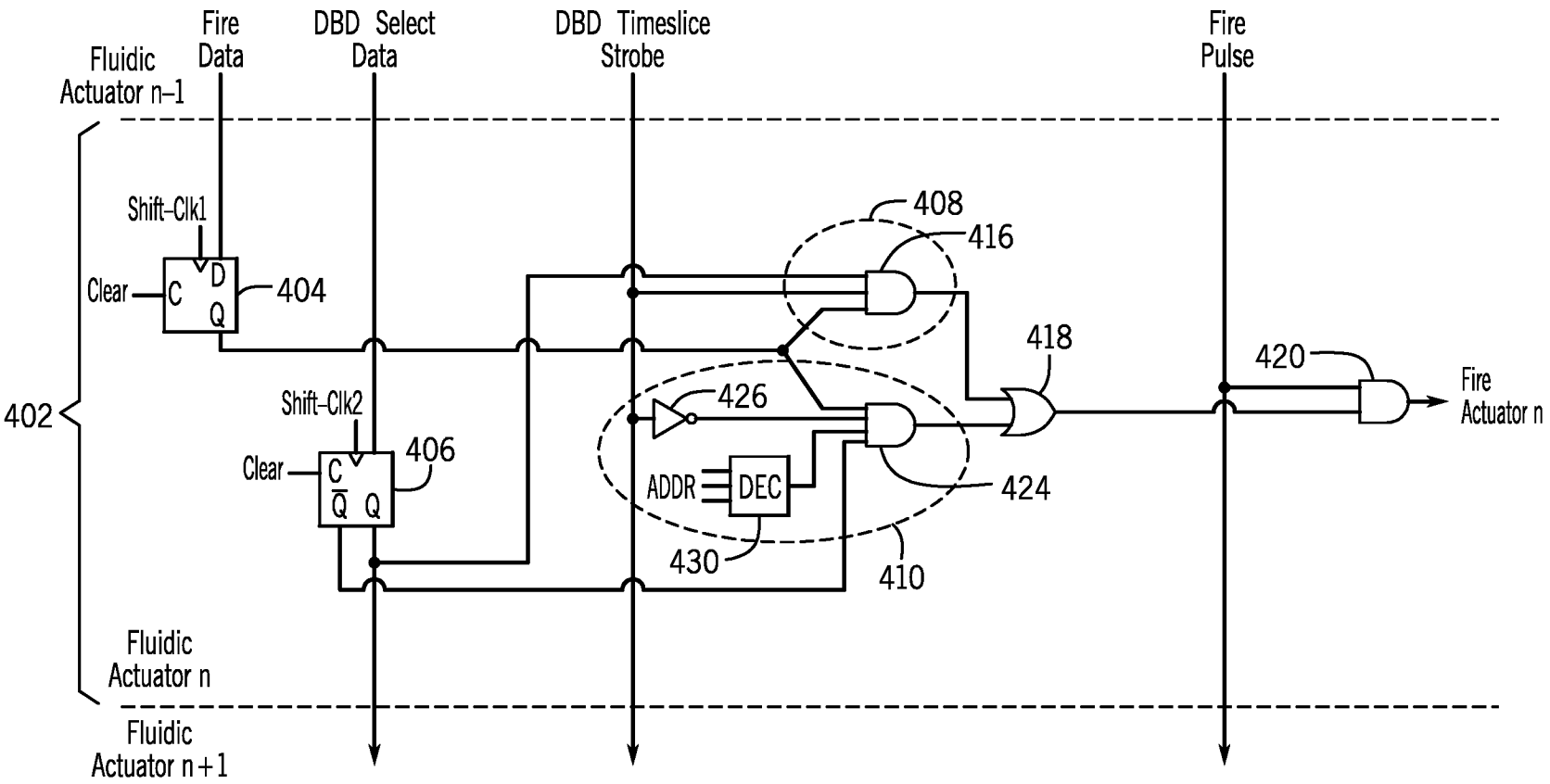
FIG. 4 is a schematic diagram of a decoder according to some examples.

FIG. 4 shows a portion 402 of the decoder 122 according to the FCB arrangement. The decoder portion 402 is for controlling activation of fluidic actuator n. The logic of the decoder portion 402 is repeated for each of the other fluidic actuators of an array (e.g., column) of fluidic actuators.

Although specific gates (in the form of AND, OR, and NAND gates, inverters, and flip-flops) are shown implementing the decoder 122, it is noted that in other examples, similar logic can be implemented with other types of circuitry, such as an ASIC, PGA, and so forth. More generally, a "logic gate" as used herein can refer to an individual gate (e.g., an AND gate, an OR gate, an inverter, a NAND gate, etc.) or a combination of gates or any other circuitry used to implement a logic functionality.

The decoder portion 402 includes a storage element 404 for storing the fire data for fluidic actuator n, and a storage element 406 for storing the DBD select data for fluidic actuator n. According to the FCB arrangement, a corresponding pair of the storage elements 404 and 406 is individually associated with each of the fluidic actuators of the array of fluidic actuators.

Each of the storage elements 404 and 406 can be implemented as a flip-flop. In such implementations, the storage element 404 can be referred to a "fire data flip-flop 404," and the storage element 406 can be referred to as a "DBD select data flip-flop 406." In other examples, the storage element 404 and/or 406 can be implemented with a different type of storage.

The fire data flip-flop 404 stores data received at the D input on a transition of a clock (Shift-Clk1) that is provided to a clock input of the fire data flip-flop 404. A Clear signal is connected to a C input of the fire data flip-flop 404, and is used to clear the flip-flop 404 to an initial state (e.g., 0), and the output of the flip-flop 404 is represented as a Q output. The Shift-Clk1 and Clear signals are part of the control signals 124 from the DBD controller 120 of FIG. 1. The Clear signal can be activated by the DBD controller 120 to clear fire data from the fire data flip-flops 404. In other examples, the Clear signal can be omitted if the DBD controller 120 loads all flip-flops 404 before any activation.

In some examples, the fire data flip-flop 404 stores one bit of data, which when set to "1" enables activation of a fluidic actuator of primitive n, and when set to "0" disables activation of a fluidic actuator in primitive n.

Although not shown, the fluid dispensing device 102 can include multiple levels of memory, including a higher-level memory and lower-level memory. The fire data to the storage element 404 is provided from the lower-level memory. Fire data in the higher-level memory can be loaded into the lower-level memory. Also, the fire data in the higher-level memory can be shifted down a shift chain of the higher-level memory elements as a clock (e.g., Shift-Clk1 or a different clock) cycles between active and inactive states. In other examples, multiple levels of memory to store fire data are not employed.

In the ensuing discussion, it is assumed that an active value of a signal or circuit node is logic "1", and that an inactive value of a signal or circuit node is logic "0". However, in different implements, an active value can correspond to logic "0", while an inactive value can correspond to logic "1".

Fire data is loaded into the storage elements 404 for the respective fluidic actuators of an array of fluidic actuators.

The DBD select data flip-flop 406 has a D input to receive the DBD select data, which can be used to select whether or not the fluidic actuator n is to be subject to a DBD measurement. The DBD select data can be provided by the system controller 110 or by the DBD controller 120.

The DBD select data flip-flop 406 also has a clock input to receive Shift-Clk2 (which is part of the control signals 124 from the DBD controller 120 of FIG. 1), and a C input to receive a Clear signal. In other examples, the Clear signal can be omitted if the DBD controller 120 loads all flip-flops 406 before any activation.

The DBD select data flip-flop 406 has a Q output.

The DBD select data for the fluidic actuators of an array of fluidic actuators is loaded into respective DBD select data flip-flops. In some examples, the DBD select data is shifted along a series of DBD select data flip-flops 406 by the cycling of Shift-Clk2.

More generally, a value stored by the storage element 406 is an example of a sense measurement indicator that can be set to a value specifying that sense measurement is to be performed for a given individual fluidic actuator.

In FIG. 4, both the non-inverting (Q) output and inverting ($\overline{Q}$) output of the DBD select data flip-flop 406 are shown. The non-inverting (Q) output of the DBD select data flip-flop 406 is provided to an input of an AND gate 416 of a DBD activate control logic 408 of the decoder portion 402. The DBD activate control logic 408 controls the activation of fluidic actuator n that is to be subjected to a DBD measurement.

The other inputs of the AND gate 416 of the DBD activate control logic 408 receive a DBD Timeslice Strobe and the output of the fire data flip-flop 404. The DBD Timeslice Strobe is part of the control signals 124 from the DBD controller 120 of FIG. 1. The DBD Timeslice Strobe is set active during the DBD activation interval of a column group. More generally, the DBD Timeslice Strobe is an example of a signal indicating that the fluid dispensing device is currently in the sense measurement interval.

Thus, if both the fire data and the DBD select data for fluidic actuator n are active, the AND gate 416 of the DBD activate control logic 408 sets its output active when the DBD Timeslice Strobe is activated during the DBD activation interval. More generally, the DBD activate control logic 408 enables the activation of fluidic actuator n in the DBD activation interval in response to the sense measurement indicator for fluidic actuator n being set active, the activate indicator for fluidic actuator n being set active, and a signal indicating the sense measurement interval.

Activation of the output of the AND gate 416 causes an OR gate 418 to activate its output that is provided to an input of a fire AND gate 420 that outputs a Fire Actuator n signal for controlling the firing of fluidic actuator n.

The decoder portion 402 also includes a normal activate control logic 410 that controls activation of fluidic actuator n that is not subjected to DBD measurement.

The other input of the OR gate 418 is connected to the output of an AND gate 424 of the normal activate control logic 410. If either the AND gate 416 or the AND gate 424 activates its output, the OR gate 418 activates its output. Effectively, the OR gate 418 activates an indication to fire fluidic actuator n if either the normal activate control logic 410 activates its output or the DBD activate control logic 408 activates its output.

The inputs of the AND gate 424 of the normal activate control logic 410 are connected to the following: the output of the fire data flip-flop 404; the inverting ($\overline{Q}$) output of the DBD select data flip-flop 406; an inverted version (as inverted by an inverter 426) of the DBD Timeslice Strobe, and an output of an address decoder 430, which receives address lines ADDR (130 in FIG. 1). The output of the inverter 426 provides a signal indicating a non-sense measurement interval (i.e., the fluid dispensing device is not in a DVD activation interval).

The AND gate 424 of the normal activate control logic 410 is disabled from activating its output in response to either the DBD select data for fluidic actuator n being active (as stored by the DBD select data flip-flop 406), or the DBD Timeslice Strobe being active. Thus, the normal activate control logic 410 does not cause activation of fluidic actuator n if the DBD select data for fluidic actuator n is active, or during the DBD activation interval (as indicated by the DBD Timeslice Strobe).

If the address lines ADDR contain an address corresponding to fluidic actuator n, then the address decoder 430 activates its output to enable the AND gate 424 to activate its output if the fire data stored in the fire data flip-flop 404 is active, and the DBD select data flip-flop 406 stores an inactive value, and the fluid dispensing device 102 is not in a DBD time interval (i.e., DBD Timeslice Strobe is inactive).

The fire AND gate 420 also receive a Fire Pulse, along with the output of the OR gate 418. The Fire Pulse is generated by the system controller 110 or the DBD controller 120 or another controller (whether as part of the fluid dispensing device 102 or off the fluid dispensing device 102), and controls when fluidic actuators are activated. The pulse width of the Fire Pulse also may control an amount of energy provided to an activated fluidic actuator.

If all inputs of the fire AND gate 420 are set active, then the fire AND gate 420 activates its output Fire Actuator n signal, which is an activation signal to activate a corresponding fluidic actuator n. If the Fire Actuator n signal is inactive, then the corresponding fluidic actuator n remains inactive. Stated differently, if the fire AND gate 420 is enabled (i.e., the input of the fire AND gate 420 connected to the output of the OR gate 418 is active), then activation of the Fire Pulse causes the corresponding activation of the Fire Actuator n signal.

In operation, to control activation of fluidic actuators of each primitive, the system controller 110 provides addresses A0 to A7 in corresponding normal activation intervals of a column group. If a given normal activation interval x (having a corresponding given address Ax) is for a given fluidic actuator x that is selected for DBD measurement, then the DBD select data in the DBD select data flip-flop 406 is active, so that activation of the given fluidic actuator x in the given normal activation interval x is suppressed in the normal activate control logic 410.

Once the sequence of normal activation intervals for respective addresses A0 to A7 have been processed, the DBD controller 120 activates the DBD Timeslice Strobe for the DBD activation interval. Note that the address corresponding to the fluidic actuator x does not have to be provided to the DBD activate control logic 408 (the address is provided to normal activate control logic 410). Upon the activation of the Fire Pulse, the fire AND gate 420 activates Fire Actuator x to activate the fluidic actuator x in the DBD activation interval.

Figure 5:
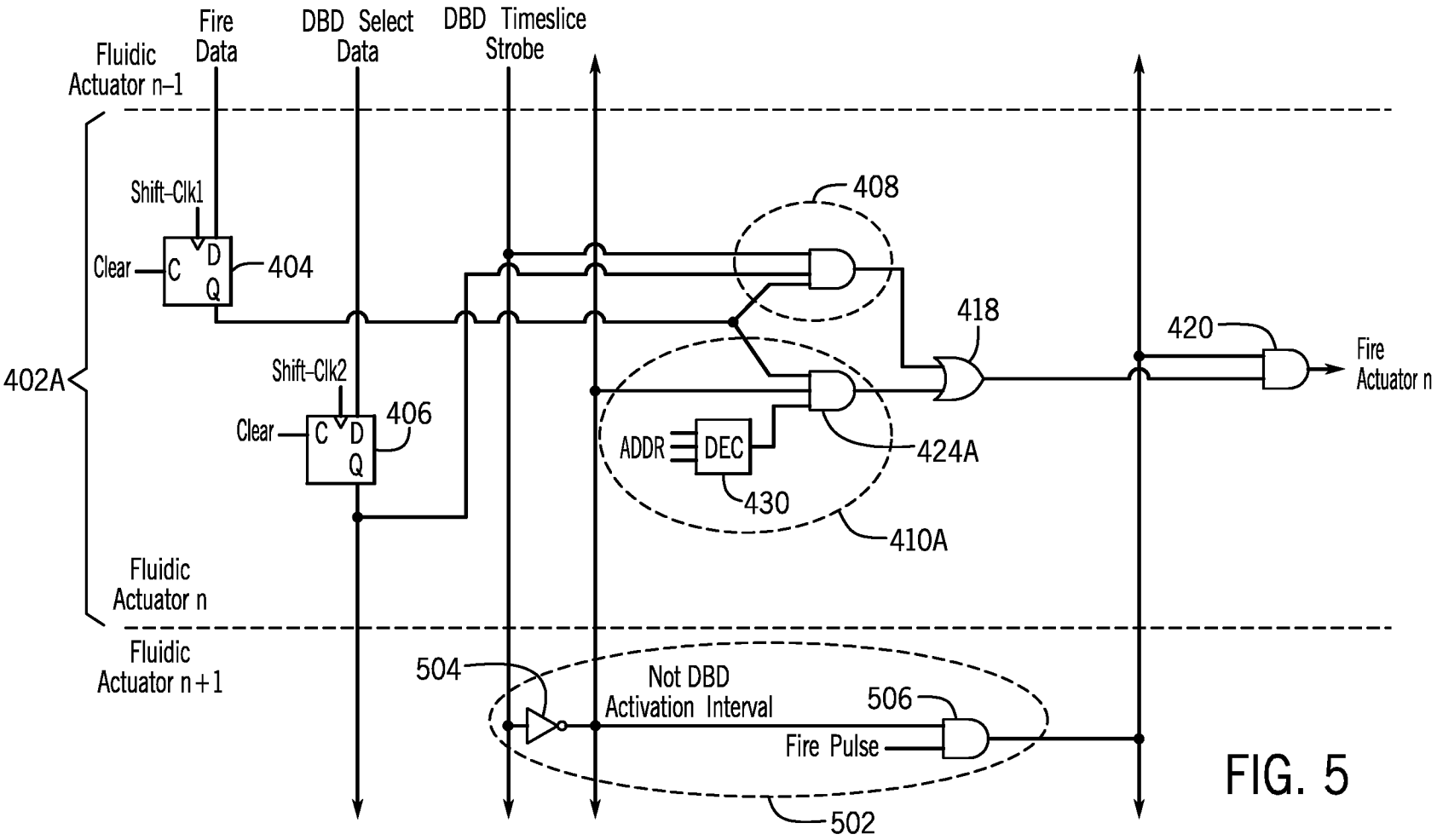
FIG. 5 is a schematic diagram of a decoder according to alternative examples.

FIG. 5 shows a decoder portion 402A according to alternative examples. The decoder portion 402A of FIG. 5 is modified from the decoder portion 402 of FIG. 4, to reduce the number of gates used for each primitive that includes a number of fluidic actuators.

In the decoder portion 402 of FIG. 4, the inverter 426 that is part of the normal activate control logic 410 is repeated for each fluidic actuator. In the decoder portion 402A of FIG. 5, a normal activate control logic 410A does not include the inverter 426. The normal activate control logic 410A includes an AND gate 424A with three inputs that receive the output of the fire data flip-flop 404, the output of the DBD select data flip-flop 406, and the output of the address decoder 430. Note that the AND gate 424 in the normal activate control logic 410 of FIG. 4 includes an additional input.

The decoder portion 402A includes a fire pulse enable logic 502 that is used for the multiple fluidic actuators of a primitive. In other words, the fire pulse enable logic 502 is shared by the multiple fluidic actuators of a primitive. Another primitive would use another fire pulse enable logic 502.

The fire pulse enable logic 502 includes an inverter 504 that produces an inverted version of the DBD Timeslice Strobe. The output of the inverter 504 provides an indication that the primitive is not in a DBD activation interval (more generally, indicating a non-sense measurement interval). The fire pulse enable logic 502 also includes an AND gate 506 having inputs connected to the output of the inverter 504 and to the Fire Pulse.

If the DBD Timeslice Strobe is not active, then the AND gate 506 is enabled and allows a state of the Fire Pulse to pass to an input of the fire AND gate 420. However, if the DBD Timeslice Strobe is active, then the AND gate 506 is disabled and blocks the Fire Pulse from pass to the input of the fire AND gate 420.

Figure 6:
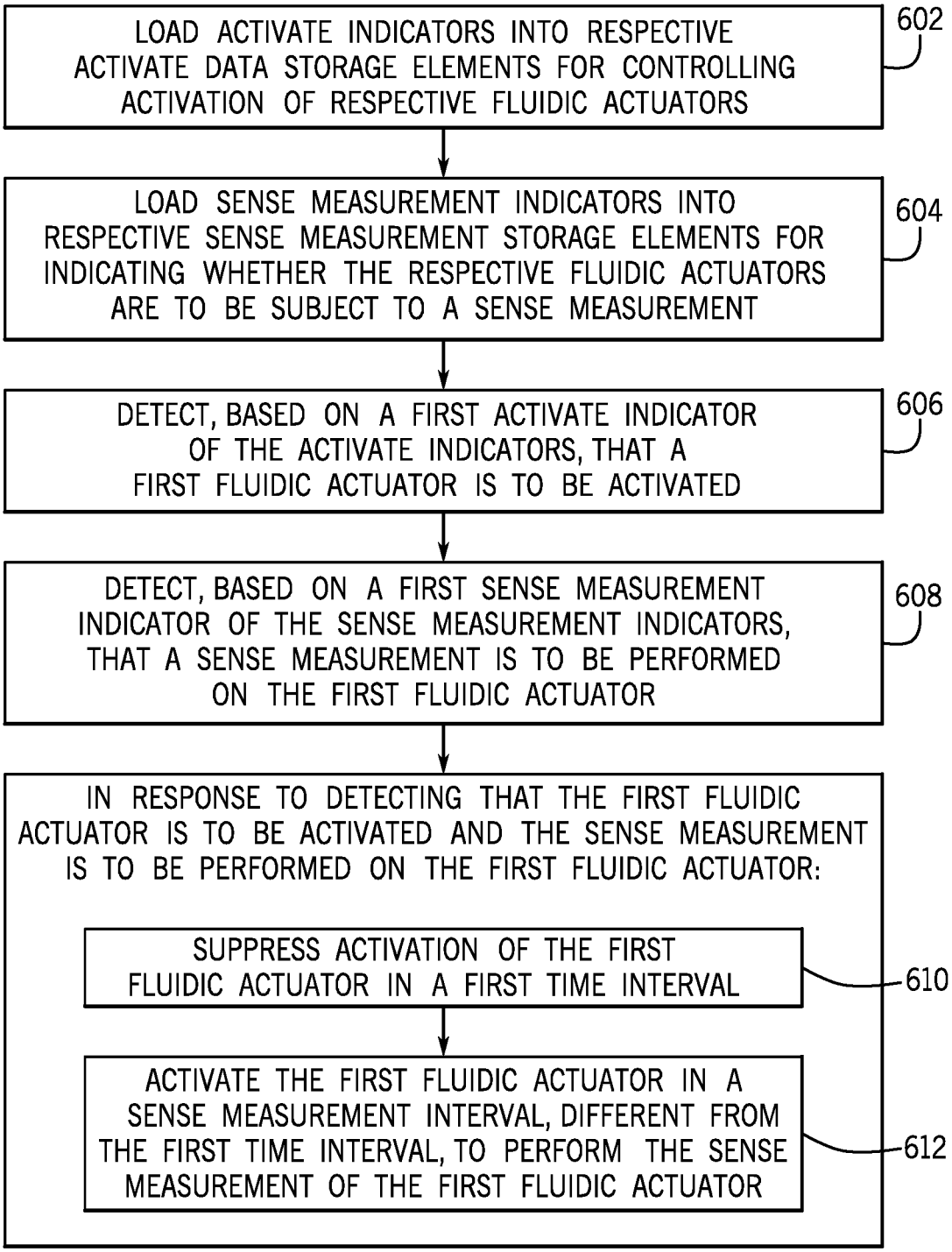
FIG. 6 is a flow diagram of a process of a fluid dispensing device according to some examples.

FIG. 6 is a flow diagram of a process of a fluid dispensing device, according to some examples. It is noted that the process of FIG. 6 does not have to follow the specific order shown, and that tasks of the process can be performed in a different order. The DBD controller 120 loads (at 602) activate indicators into respective activate data storage elements (e.g., 204 in FIG. 2 or 404 in FIG. 4 or 5) for controlling activation of respective fluidic actuators.

The DBD controller 120 loads (at 604) sense measurement indicators into respective sense measurement storage elements (e.g., 206 in FIG. 2 or 406 in FIG. 4 or 5) for indicating whether the respective fluidic actuators are to be subject to a sense measurement.

The decoder 122 detects (at 606), based on a first activate indicator of the activate indicators, that a first fluidic actuator is to be activated. The decoder 122 detects (at 608), based on a first sense measurement indicator of the sense measurement indicators, that a sense measurement is to be performed on the first fluidic actuator.

In response to detecting that the first fluidic actuator is to be activated and the sense measurement is to be performed on the first fluidic actuator, the decoder 122 suppresses (at 610) activation of the first fluidic actuator in a first time interval, and activates (at 612) the first fluidic actuator in a sense measurement interval, different from the first time interval, to perform the sense measurement of the first fluidic actuator.

Figure 7:
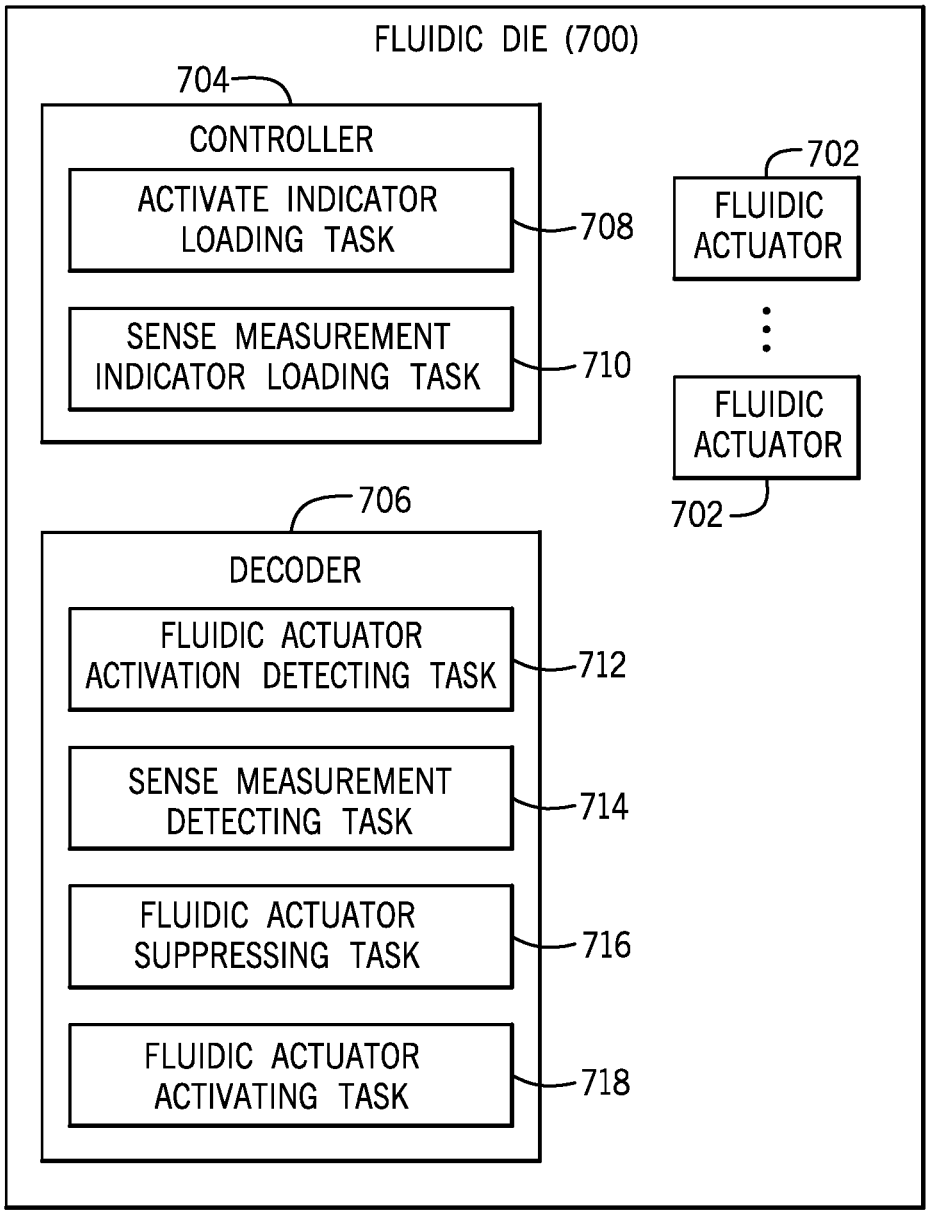
FIG. 7 is a block diagram of a fluidic die according to further examples.

FIG. 7 is a block diagram of a fluidic die 700 including a plurality of fluidic actuators 702, a controller 704, and a decoder 706. The controller 704 is to perform various tasks, including an activate indicator loading task 708 and a sense measurement indicator loading task 710. The activate indicator loading task 708 loads respective activate indicators for controlling activation of respective fluidic actuators of the plurality of fluidic actuators 702. The sense measurement indicator loading task 710 loads respective sense measurement indicators for indicating whether the respective fluidic actuators 702 are to be subject to a sense measurement.

The decoder 706 is to perform various tasks. The tasks of the decoder 706 include a fluidic actuator activation detecting task 712 and a sense measurement detecting task 714. The fluidic actuator activation detecting task 712 detects, based on a first activate indicator of the activate indicators, that a first fluidic actuator is to be activated. The sense measurement detecting task 714 detects, based on a first sense measurement indicator of the sense measurement indicators, that a sense measurement is to be performed on the first fluidic actuator.

The decoder 706 also performs a fluidic actuator suppressing task 716 and a fluidic actuator activating task 718 in response to detecting that the first fluidic actuator is to be activated and the sense measurement is to be performed on the first fluidic actuator. The fluidic actuator suppressing task 716 suppresses activation of the first fluidic actuator in a first time interval, and the fluidic actuator activating task 718 activates the first fluidic actuator in a sense measurement interval, different from the first time interval, to perform the sense measurement of the first fluidic actuator.

In examples where the controller 110 (FIG. 1) or 704 (FIG. 7), or decoder 122 (FIG. 1), or 208 (FIG. 2), or 706 (FIG. 7) is implemented as a combination of a hardware processing circuit and machine-readable instructions, the controller or decoder can include a processor and a non-transitory machine-readable or computer-readable storage medium storing machine-readable instructions executable on the processor to perform respective tasks.

A processor can include a microprocessor, a core of a multi-core microprocessor, a microcontroller, a programmable integrated circuit, a programmable gate array, or another hardware processing circuit. Machine-readable instructions executable on a processor can refer to the instructions executable on a single processor or the instructions executable on multiple processors.

The storage medium can include any or some combination of the following: a semiconductor memory device such as a dynamic or static random access memory (a DRAM or SRAM), an erasable and programmable read-only memory (EPROM), an electrically erasable and programmable read-only memory (EEPROM) and flash memory; a magnetic disk such as a fixed, floppy and removable disk; another magnetic medium including tape; an optical medium such as a compact disk (CD) or a digital video disk (DVD); or another type of storage device. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site (e.g., a cloud) from which machine-readable instructions can be downloaded over a network for execution.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid dispensing device comprising:

a plurality of fluidic actuators;

activate data storage elements to store respective activate indicators for controlling activation of respective fluidic actuators of the plurality of fluidic actuators;

sense measurement storage elements to store respective sense measurement indicators for indicating whether the respective fluidic actuators are to be subject to a sense measurement; and a decoder to:

detect, based on a first activate indicator of the activate indicators, that a first fluidic actuator is to be activated;

detect, based on a first sense measurement indicator of the sense measurement indicators that a sense measurement is to be performed on the first fluidic actuator; and in response to detecting that the first fluidic actuator is to be activated and the sense measurement is to be performed on the first fluidic actuator:

suppress activation of the first fluidic actuator at a first time, and activate the first fluidic actuator at a second time corresponding to a sense measurement interval to perform the sense measurement of the first fluidic actuator.

2. The fluid dispensing device of claim 1, wherein the decoder comprises a logic gate to enable activation of the first fluidic actuator at the first time in response to the first sense measurement indicator set inactive and the first activate indicator being set active.

3. The fluid dispensing device of claim 2, wherein the logic gate is to enable the activation of the first fluidic actuator at the first time further in response to an address selecting the first fluidic actuator.

4. The fluid dispensing device of claim 3, wherein the logic gate is to enable the activation of the first fluidic actuator at the first time further in response to a signal indicating a non-sense measurement interval.

5. The fluid dispensing device of claim 4, wherein the decoder is to activate the first fluidic actuator at the first time in response to a fire pulse and the enabling of the activation of the first fluidic actuator at the first time.

6. The fluid dispensing device of claim 1, wherein the decoder comprises a logic gate to enable the activation of the first fluidic actuator at the second time in response to the first sense measurement indicator set active, the first activate indicator being set active, and a signal indicating the sense measurement interval.

7. The fluid dispensing device of claim 6, wherein the decoder is to activate the first fluidic actuator at the second time in response to a fire pulse and the enabling of the activation of the first fluidic actuator at the second time.

8. The fluid dispensing device of claim 1, wherein the first time corresponds to a normal time interval scheduled for activation of the first fluidic actuator by fluid control data, wherein the normal time interval is different from the sense measurement interval.

9. The fluid dispensing device of claim 1, wherein loading of data to control activation of respective fluidic actuators is performed by shifting the data into activate data storage elements.

10. The fluid dispensing device of claim 1, wherein the sense measurement storage elements are arranged as a series of sense measurement storage elements, and loading of sense measurement data to control sense measurement of respective fluidic actuators is performed by shifting the sense measurement data through the series of sense measurement storage elements.

11. A fluidic die comprising:

a plurality of fluidic actuators;

a controller to:

load respective activate indicators for controlling activation of respective fluidic actuators of the plurality of fluidic actuators; and load respective sense measurement indicators for indicating whether the respective fluidic actuators are to be subject to a sense measurement; and a decoder to:

detect, based on a first activate indicator of the activate indicators, that a first fluidic actuator is to be activated;

detect, based on a first sense measurement indicator of the sense measurement indicators that a sense measurement is to be performed on the first fluidic actuator; and in response to detecting that the first fluidic actuator is to be activated and the sense measurement is to be performed on the first fluidic actuator:

suppress activation of the first fluidic actuator in a first time interval, and activate the first fluidic actuator in a sense measurement interval, different from the first time interval, to perform the sense measurement of the first fluidic actuator.

12. The fluidic die of claim 11, wherein the plurality of fluidic actuators are arranged in multiple primitives each including plural fluidic actuators, and wherein activations of fluidic actuators of each primitive are controlled by respective different addresses.

13. The fluidic die of claim 12, wherein the controller is to:

send a plurality of fire pulses to cause activations of corresponding fluidic actuators if enabled, each fire pulse of the plurality of fire pules provided with a respective different address.

14. A method of a fluid dispensing device, comprising:

loading activate indicators into respective activate data storage elements for controlling activation of respective fluidic actuators;

loading sense measurement indicators into respective sense measurement storage elements for indicating whether the respective fluidic actuators are to be subject to a sense measurement;

detecting, by a decoder based on a first activate indicator of the activate indicators, that a first fluidic actuator is to be activated;

detecting, by the decoder based on a first sense measurement indicator of the sense measurement indicators, that a sense measurement is to be performed on the first fluidic actuator; and in response to detecting that the first fluidic actuator is to be activated and the sense measurement is to be performed on the first fluidic actuator:

suppressing activation of the first fluidic actuator in a first time interval, and activating the first fluidic actuator in a sense measurement interval, different from the first time interval, to perform the sense measurement of the first fluidic actuator.

15. The method of claim 14, wherein the suppressing of the activation of the first fluidic actuator in the first time interval is responsive to the first sense measurement indicator being set active.

* * * * *